US005161439A

United States Patent [19]

Wesch, Jr.

[11] Patent Number: 5,161,439

[45] Date of Patent: Nov. 10, 1992

[54] PIVOTING JAW ASSEMBLY

[76] Inventor: William E. Wesch, Jr., P.O. Box 337, Humble, Tex. 77347

[21] Appl. No.: 779,894

[22] Filed: Oct. 21, 1991

[51] Int. Cl.[5] ..... B25B 13/50

[52] U.S. Cl. ..... 81/57.33; 81/57.14; 81/57.15; 81/57.18; 81/57.2

[58] Field of Search ..... 81/57.14, 57.15, 57.16, 81/57.18, 57.2, 57.21, 57.3, 57.33, 57.34

[56] References Cited

U.S. PATENT DOCUMENTS 4,346,629 8/1982 Kinzbach ..... 81/57.15 X 4,869,137 9/1987 Slator ..... 81/57.18

*Primary Examiner*—D. S. Meislin

*Attorney, Agent, or Firm*—Jack A. Kanz

[57] ABSTRACT

Interfering bosses are provided on the jaw and jaw link forming a pivoting jaw assembly for a power tong or back-up. The bosses are arranged to interfere and prevent over-center rotation of the jaw with respect to the jaw link. The jaw is pivotally mounted on the jaw link with a pin journaled in an aperture which is elongated in the direction of the axis of the bosses so that the jaw can be rotated over-center when desired.

6 Claims, 1 Drawing Sheet

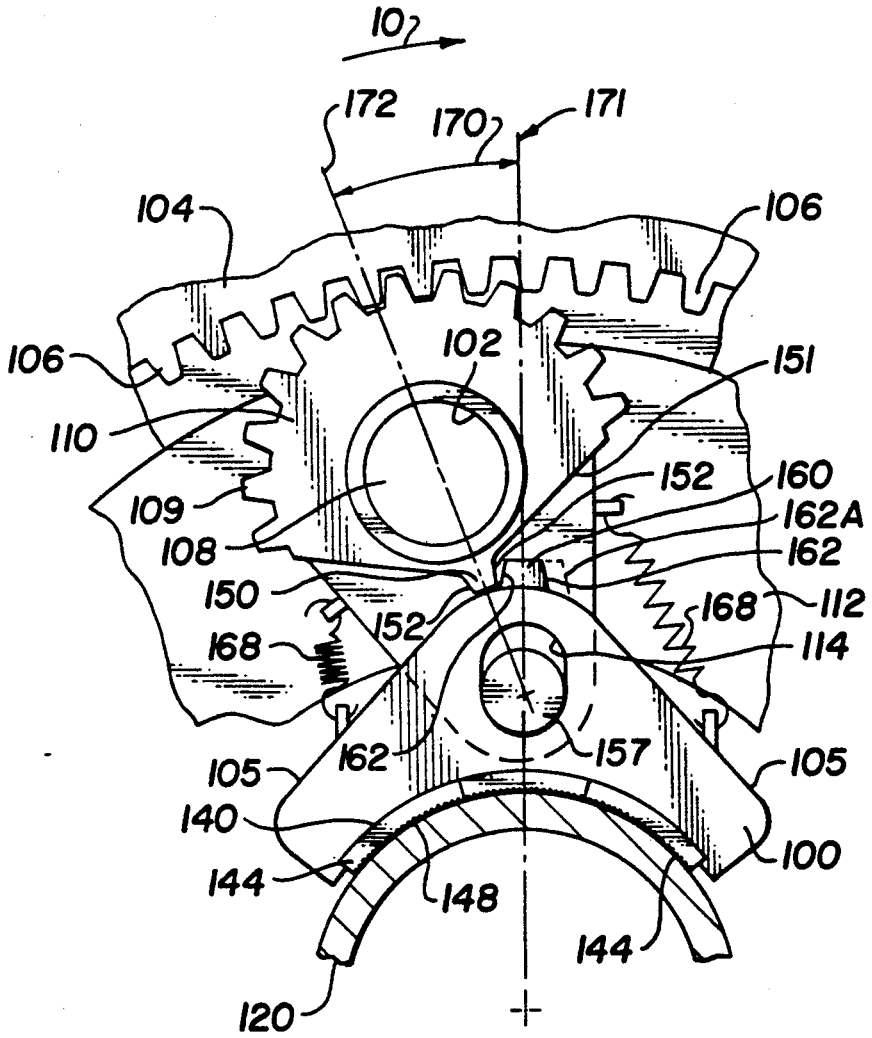
10
172
170
171
104
106
106
102
151
110
152
160
109
162A
108
162
150
168
112
152
168
114
162
157
105
105
140
100
144
148
144
120

PIVOTING JAW ASSEMBLY

This invention relates to gripping jaws for power tongs and back-ups. More particularly, it relates to gripping jaw and jaw link assembles for applying controlled gripping force and rotational torque to a tubular member such as a pipe or the like.

Power devices used to attach ("make-up") and detach ("break-out") the threaded ends of tubular goods such as pipe sections and the like are commonly known as power tongs. Such power tongs grip the tubular element and rotate it as the end of one section is threaded into an adjacent section. A device known as a back-up is usually used in conjunction with power tongs to hold the adjacent tubular section and prevent its rotation. Power tongs and back-ups are, of course, quite similar, the major difference being the ability of tongs to rotate the tubular element.

Power tongs and back-ups generally employ a plurality of gripping assemblies, each of which includes a jaw which moves radially toward a tubular element to engage the tubular element. In the case of power tongs, the jaw is moved radially into engagement with the tubular element and then rotated concentrically about the axis of the tubular element to rotate the tubular element and therefore make-up or break-out the joint.

Damage to pipe and the like by deformation, scoring, etc., by the jaws during make-up and break-out is always a matter of concern and various recent developments in tong design have drastically reduced such damage. One of the most important developments has been the articulated jaw assembly in which the jaw is pivotally secured to a jaw link which is pivotally supported on a drag ring and rotated about its supporting pivot by a drive gear to move the jaw radially into engagement with the pipe. When the jaw engages the pipe, the drag ring, jaw assembly and pipe are rotated together by the drive gear and the jaw thus applies radial gripping force which is proportional to the rotational force applied to the drive gear. Power tongs and back-ups employing such articulated jaw assemblies are disclosed in co-pending application for United States Letters Patent entitled Power Tongs With Improved Gripping Means filed Sep. 16, 1991 under Ser. No. 07/760,322 which is hereby incorporated herein by reference.

Articulated jaw assemblies as described above are quite effective in reducing damage to pipe and the like because the radial gripping force applied is proportional to the rotational force applied. Thus as rotational force is increased, gripping force is increased. This condition can exist, however, only if there is an angle, known as the force angle, between the radial line extending between the center of the tubular element and the center of the pivot about which the jaw rotates and the line extending between the center of the point about which the jaw rotates and the pivot about which the jaw link rotates. When the force angle becomes zero (the center of both pivots is aligned with the center of the tubular element) the jaw is extended the maximum radial distance it can be extended. Further rotation of the assembly results in withdrawing the jaw from the tubular element. This condition (known as over-center rotation) must be avoided to prevent loss of contact between the jaw and the tubular element.

In accordance with the invention over-center movement of the jaw with respect to the jaw link is avoided by providing interfering bosses on the jaw and jaw link. The interfering bosses are arranged to extend from the jaw and jaw link, respectively, in positions so that the bosses engage each other and prevent further rotation of the jaw with respect to the jaw link when a pre-determined minimum force angle has been obtained. When the bosses are engaged, additional rotational force does not increase the gripping force. Since further rotation of the jaw with respect to the jaw link is prevented by the engaged bosses, the jaw cannot be rotated over-center, thus loss of jaw contact by over-center rotation is prevented. Furthermore, by limiting the radial extension distance of the jaw, application of radial gripping force is limited and the likelihood of collapsing the tubular element by application of excessive gripping force is reduced. Other advantages and features of the invention will become more readily understood from the following detailed description taken in conjunction with the appended claims and attached drawing in which:

The sole figure is a plan view of a jaw assembly embodying preferred embodiment of the invention. The embodiment illustrated comprises a jaw 100 pivotally supported on a jaw link 110 by pin 157. The jaw link 110 comprises a somewhat elongated body having first and second opposite ends and an aperture 102 located on a central axis so that the opposite ends may rotate about the central aperture 102. A support pin 108 carried by drag ring 112 is journaled in aperture 102 so that jaw link 110 is carried by the drag ring 112 but may rotate about pin 108. It will be readily recognized that although the drawing illustrates a pin 108 carried by the drag ring journaled in an aperture 102 in the jaw link, the arrangement may be reversed so that the pivot pin is carried by the jaw link and journaled in an aperture in the drag ring 112. Any other mechanical equivalent which permits the jaw link 110 to pivot about a point fixed on the drag ring 112 may be used.

The first end of jaw link 110 is provided with drive means such as teeth 109 which mesh with similar teeth 106 on drive gear 104 so that rotation of drive gear 104 with respect to drag ring 112 causes jaw link 110 to pivot about pin 108. The opposite end of jaw link 110 carries a pivot pin 157 which extends parallel with pin 108. Pin 157 is journaled within an elongated aperture 114 in the jaw 100 so that jaw 100 may pivot about pin 157. As indicated above, the pin and elongated aperture may be reversed or any other mechanical equivalent used to pivotally support the jaw 100 on the jaw link 110.

Jaw 100 has an arcuate gripping face adapted to engage and grip a tubular element such as pipe 120. It will be recognized that the size and shape of the gripping face will be determined by the size, shape, etc., of the article to be gripped. For purposes of this disclosure, a pipe 120 which is circular in cross-section is illustrated. However, the article to be gripped need not necessarily be circular in cross-section or cylindrical. Pipe 120 is described as illustrative of any axially elongated member which is to be gripped and rotated by power tongs or gripped and restrained from rotation by a back-up. As used herein, the terms "tubular member" and "pipe" refer to any such axially elongated member.

In the embodiment illustrated, the arcuate face of the jaw 100 includes a recess or cavity 140 into which a plurality of inserts 144 having gripping teeth 148 are secured. The radius of curvature of the arc defined by the teeth 148 should, of course, coincide with the radius of curvature of the outer surface of the pipe 120. Various shapes, sizes, properties, etc., of inserts 144 are well known in the art.

Since jaw 100 is free to rotate about pin 157, means for orientating the arcuate face toward the pipe may be provided. In the embodiment illustrated, springs 168 are secured between the jaw link 110 and opposite arms 105 of the jaw 100. The springs 168 generally orient the jaw 100 so that the arcuate face is aligned substantially along the axis of the jaw link. However, when either arm 105 engages the pipe 120, springs 168 are respectively stretched and compressed to permit the arcuate face of the jaw 100 to engage the pipe 120.

It will be appreciated that rotation of drive gear 104 in the direction indicated by arrow 10 (while maintaining drag ring 112 fixed with respect to the drive gear) causes jaw link 110 to pivot about pin 108 and thus move jaw 100 radially toward pipe 120. When jaw 100 is firmly in contact with pipe 120, jaw link 110 can rotate no further. Drag ring 112 then rotates with drive gear 104, thus causing pipe 120 to rotate with drive gear 104. When drive gear 104 is rotated in the opposite direction, jaw 100 is withdrawn from the pipe.

Referring to the drawing it will be observed that the gripping force of the jaw 100 applied radially along dashed line 171 is proportional to the rotational torque applied by the drive gear 104 and a function of the force angle 170 between radial line 171 and the axis 172 of the jaw link 110. It will also be observed that when the force angle becomes zero (axis 172 is coincident with radial line 171) the jaw 100 is extended toward the pipe as far as possible. Further rotation of the jaw link 110 would cause the jaw 100 to be withdrawn from the pipe 120. Such over-center condition can occur when the diameter of pipe 120 is too small for the jaw assembly in use or when the diameter of the pipe 120 is reduced by the radial force exerted by the jaw 100.

In accordance with the invention, over-center rotation of the jaw assembly is prevented by providing the jaw link 110 and jaw 100 with interfering bosses 150 and 160, respectively. In the embodiment illustrated boss 150 extends axially from shoulder 151 on the face of jaw link 110. A similar boss 160 extends from the base of jaw 100 so that as jaw 100 rotates around pin 157, side face 152 of boss 150 engages side face 162 of boss 160. When the bosses 150 and 160 are engaged, further rotation of the jaw 100 about pivot pin 157 is prevented. In the locked condition, the radial force exerted by jaw 100 is not increased as torque is increased. Thus blocking the jaw against over-center rotation also limits the radial force applied.

It will be readily recognized that since power tongs and back-ups are used for both making and breaking joints, the jaw assemblies are adapted to operate in either direction of rotation. For example, the drawing illustrates the arrangement used to rotate pipe 120 in the direction indicated by arrow 10. In order to rotate pipe 120 in the opposite direction, the jaw 100 is rotated about pin 157 so that radial line 171 lies on the opposite side of line 172. Reversal of the jaw position, of course, must occur when there is no pipe to interfere with over-center rotation.

In order to permit over-center rotation of the jaw assembly of the invention when desired, aperture 114 is elongated along the axis of the jaw (along radial line 171) so that the jaw 100 may move axially sufficiently to permit bosses 150 and 160 to pass without interference. Reversal of the jaw 100 occurs only in the absence of pipe, thus axial movement of the jaw is restricted only by the pivot pin 157 and any orientation devices such as springs 168. In the preferred embodiment, the mating surfaces 152 and 162 of bosses 150 and 160, respectively, are inclined with respect to the respective axes of the jaw link 110 and jaw 100 so that when the faces 152 and 162 are engaged without an axial load in the arcuate face of the jaw 100, the faces 152 and 162 slide over each other. Obviously, the length of the elongated aperture 114 must be sufficient to permit bosses 150 and 160 to pass when there is no load on the jaw. However, when the jaw 100 is engaging pipe 120, boss 160 cannot pass boss 150 (in either direction) and over-center movement of the jaw is prevented.

In the embodiment illustrated bosses 150 and 160 are symmetrical and of approximately equal dimensions. It will be appreciated, however, that the sizes and shapes of the bosses 150 and 160 can be varied as desired to determine the minimum permissible force angle. Furthermore, the width of either or both bosses may be varied as desired on either side of the axes 171 and 172 so that the minimum force angle in one direction of rotation is different from the minimum permissible force angle in the opposite direction. Furthermore, either or both faces 152 and 162 may be provided with expansion shims or the like (illustrated in phantom at 162A) which may be added or removed to vary the minimum force angle 170 as desired.

It should be understood that although the bosses 150 and 160 are illustrated at particular positions on the jaw link and jaw, respectively, the forms and locations of the bosses are not limited to those disclosed. Interfering bosses or other structural configurations of the pivoting jaw and jaw link which are arranged to prevent over-center rotation may be devised to accomplish the functions of the invention. It will be understood, therefore, that although the invention has been described with particular reference to a specific embodiment thereof, the form shown and described in detail it is to be taken as a preferred embodiment. Various changes and modifications may be resorted to without departing from the spirit and scope of the invention as defined by the appended claims.

What is claimed:

1. A jaw assembly comprising:

(a) a jaw link comprising:

(i) a body rotatable about a pivot point and having pivot means for supporting a jaw thereof, said body having a central axis defined by a straight line passing through the centers of said pivot point and said pivot means;

(ii) support means for supporting the jaw link for rotation about said pivot point;

(iii) drive means for rotating said body about said pivot point; and (iv) first boss mean shaving an axis of extension adapted to engage a jaw and limit rotation of the jaw about said pivot means; and (b) a jaw mounted to rotate about said pivot means comprising:

(i) a jaw body defining an arcuate gripping face adapted to engage a tubular member; and (ii) second boss means extending from said jaw body along an axis of extension and adapted to engage said first boss means and thereby prevent rotation of said jaw abut said pivot means to a position wherein the point on said arcuate face nearest said pivot means is aligned with said central axis when said gripping face is engaged with a tubular member.

2. A jaw assembly as defined in claim 1 wherein said second boss means comprises a boss extending from said jaw and has a face adapted to engage a corresponding face on said first boss means.

3. A jaw assembly as defined in claim 2 wherein said face on said second boss means lies in a plane which is inclined with respect to the central axis of said jaw.

4. A jaw assembly as defined in claim 1 wherein said pivot means includes a pivot pin carried by one of said jaw and said jaw link journaled in an elongated aperture in the other of said jaw and said jaw link.

5. A jaw assembly as defined in claim 4 wherein said elongated aperture is elongated in a direction substantially parallel with the axis of the boss on the said other of said jaw and said jaw link having said elongated aperture.

6. A jaw assembly comprising:

(a) a jaw link comprising:

(i) a body rotatable about a pivot point;

(ii) support means pivotally supporting the jaw link for rotation thereabout;

(iii) drive means for rotating said body about said support means;

(iv) pivot means for pivotally supporting a jaw on said body; and (v) first boss means having an axis of extension adapted to engage a jaw and limit rotation of the jaw about said pivot means; and (b) a jaw pivotally mounted to rotate about said pivot means comprising:

(i) a body having an arcuate gripping face adapted to engage a tubular member; and (ii) second boss means having an axis of extension extending from said jaw body and adapted to engage said first boss means and thereby limit rotation of said jaw about said pivot means, wherein said pivot means includes a pivot pin carried by one of said jaw and said jaw link journaled in an elongated aperture in the other of said jaw and said jaw link and wherein said aperture is elongated in a direction substantially parallel with the axis of the boss means on the said other of said jaw and said jaw link.

* * * * *

UNITED STATES PATENT AND TRADEMARK OFFICE

CERTIFICATE OF CORRECTION

PATENT NO. : 5,161,439

DATED : November 10, 1992

INVENTOR(S) : William E. Wesch, Jr.

It is certified that error appears in the above-identified patent and that said Letters Patent is hereby corrected as shown below:

Column 2, line 21, after "bodying" insert ---a---

Column 4, line 48, change "thereof" to ---thereon---

Column 4, line 56, change "mean shaving" to ---means having---

Signed and Sealed this

Twelfth Day of October, 1993

*Attest:*

*Attesting Officer*

BRUCE LEHMAN

*Commissioner of Patents and Trademarks*